US009964909B2

(12) United States Patent
Tsugane

(10) Patent No.: US 9,964,909 B2
(45) Date of Patent: May 8, 2018

(54) SHEET CONVEYING DEVICE AND SHEET ACCUMULATING DEVICE PROVIDED WITH THE SAME

(71) Applicant: Shin Tsugane, Yamanashi-ken (JP)

(72) Inventor: Shin Tsugane, Yamanashi-ken (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 182 days.

(21) Appl. No.: 14/996,859

(22) Filed: Jan. 15, 2016

(65) Prior Publication Data

US 2016/0252866 A1 Sep. 1, 2016

(30) Foreign Application Priority Data

Feb. 27, 2015 (JP) ..... 2015-038281

(51) Int. Cl.

| | |
|---|---|
| ***B41F 13/54*** | (2006.01) |
| ***G03G 15/00*** | (2006.01) |
| ***B65H 5/02*** | (2006.01) |
| ***B65H 31/02*** | (2006.01) |
| ***B41F 13/56*** | (2006.01) |
| ***B65H 45/04*** | (2006.01) |
| ***B65H 37/04*** | (2006.01) |
| ***B65H 31/28*** | (2006.01) |
| ***B65H 31/36*** | (2006.01) |

(52) U.S. Cl.

CPC ..... *G03G 15/6529* (2013.01); *B41F 13/54* (2013.01); *B41F 13/56* (2013.01); *B65H 5/021* (2013.01); *B65H 31/02* (2013.01); *B65H 31/28* (2013.01); *B65H 31/36* (2013.01); *B65H 37/04* (2013.01); *B65H 45/04* (2013.01); *G03G 15/6538* (2013.01); *B65H 2301/4212* (2013.01); *B65H 2301/4213* (2013.01); *B65H 2404/2421* (2013.01); *B65H 2404/265* (2013.01); *B65H 2404/2693* (2013.01); *B65H 2404/65* (2013.01); *B65H 2801/27* (2013.01)

(58) Field of Classification Search

CPC ..... B41F 13/54; B41F 13/56; B65H 31/02; B65H 31/28; B65H 37/04; B65H 45/04; B65H 2404/65

USPC ..... 270/58.11, 58.12, 58.17, 58.27

See application file for complete search history.

(56) References Cited

U.S. PATENT DOCUMENTS 5,020,784 A * 6/1991 Asami ..... B42C 1/12 270/58.11
6,601,846 B2 * 8/2003 Saito ..... B65H 37/04 270/58.12

(Continued)

FOREIGN PATENT DOCUMENTS

JP 2009-035417 A 2/2009

*Primary Examiner* — Leslie A Nicholson, III
(74) *Attorney, Agent, or Firm* — Manabu Kanesaka

(57) ABSTRACT

The present invention is to provide a sheet conveying device capable of reducing noise. The sheet conveying device includes an endless belt that gives a conveying force to a sheet and a rotating member engaged with an outer peripheral portion of the endless belt. The endless belt has, on its outer peripheral portion, a plurality of convex portions arranged in a peripheral direction thereof, the convex portions each extending in a width direction thereof. The rotating member has a contact portion that contacts the outer peripheral portion of the endless belt and deforms a plurality of points of each of the convex portions in the width direction.

10 Claims, 7 Drawing Sheets

(56) References Cited

U.S. PATENT DOCUMENTS

| | | | | |
|---|---|---|---|---|
| 7,461,837 | B2 * | 12/2008 | Saito | B42C 1/12 270/58.07 |
| 2015/0042032 | A1 * | 2/2015 | Abe | B65H 3/045 271/10.15 |

* cited by examiner

SHEET CONVEYING DEVICE AND SHEET ACCUMULATING DEVICE PROVIDED WITH THE SAME

RELATED APPLICATIONS

The present application is based on, and claims priority from, Japanese Application No. 2015-038281 filed Feb. 27, 2015, the disclosure of which is hereby incorporated by reference herein in its entirety.

BACKGROUND OF THE INVENTION

Field of the Invention

The present invention relates to a sheet accumulating device that loads and accumulates thereon sheets that have been fed to a sheet discharge port and to improvement of a conveying mechanism that conveys sheets fed from the sheet discharge port to a predetermined position.

Description of the Related Art

There are various types of mechanisms that load and accumulates, on a loading surface disposed downstream of a sheet discharge port, sheets on which an image has been formed by an image forming apparatus. For example, a post-processing device disclosed in Patent Document 1 is connected to the sheet discharge port of the image forming apparatus, guides the image-formed sheets to a predetermined post-processing tray and accumulates the sheets thereon, and houses the post-processed sheets in a downstream side stack tray.

More specifically, in Patent Document 1, processing tray is disposed downstream of the sheet discharge port, and the processing tray is provided with a sheet end regulating section that regulates positions of sheet ends by making the sheet ends abut thereagainst and an endless belt mechanism that conveys the sheets to the regulating section.

In the endless belt mechanism, a flexible belt is suspended from above the processing tray onto a topmost sheet and rotated in a conveying direction. In general, such a belt has on its surface a plurality of convexes with a V-shaped cross section. Forming the convexes on the belt surface increases friction with the sheet that contact the belt surface, allowing reduction of a pressing force that presses the belt against the sheet.

PRIOR ART DOCUMENT

Patent Document

[Patent Document 1] Japanese Patent Application Publication No. 2009-35417

SUMMARY OF THE INVENTION

When the endless belt as described above is rotated, the convexes on the belt surface strike a surface of a rotating body to generate noise (collision sound). An object of the present invention is to reduce noise generated in a sheet conveying device using the endless belt.

To achieve the above object, there is provided a sheet conveying device including an endless belt that gives a conveying force to a sheet and a rotating member engaged with an outer peripheral portion of the endless belt. The endless belt has, on its outer peripheral portion, a plurality of convex portions arranged in a peripheral direction thereof, the convex portions each extending in a width direction thereof. The rotating member has a contact portion that contacts the outer peripheral portion of the endless belt and deforms a plurality of points of each of the convex portions in the width direction.

The contact portion that contacts the convex surface of the conveying belt and non-contact portion that does not contact the convex surface are formed on the outer peripheral surface of the driven rotating member to be engaged with the conveying belt, so that it is possible to reduce noise when the driven rotating member 30 overrides the convex surface formed on the outer periphery of the conveying belt.

BRIEF DESCRIPTION OF THE DRAWINGS

FIGS. 3A and 3B are explanatory views of operation of the sheet carry-in mechanism, in which FIG. 3A illustrates a standby state, and FIG. 3B illustrates an operating state;

FIGS. 4A and 4B are partially enlarged views of the sheet carry-in mechanism, in which FIG. 4A is a front view, and FIG. 4B is a perspective view;

FIGS. 7A and 7B are explanatory views of a second embodiment, in which FIG. 7A is a perspective view, and FIG. 7B is an enlarged view of an engagement potion.

DESCRIPTION OF THE PREFERRED EMBODIMENTS

Figure 1:
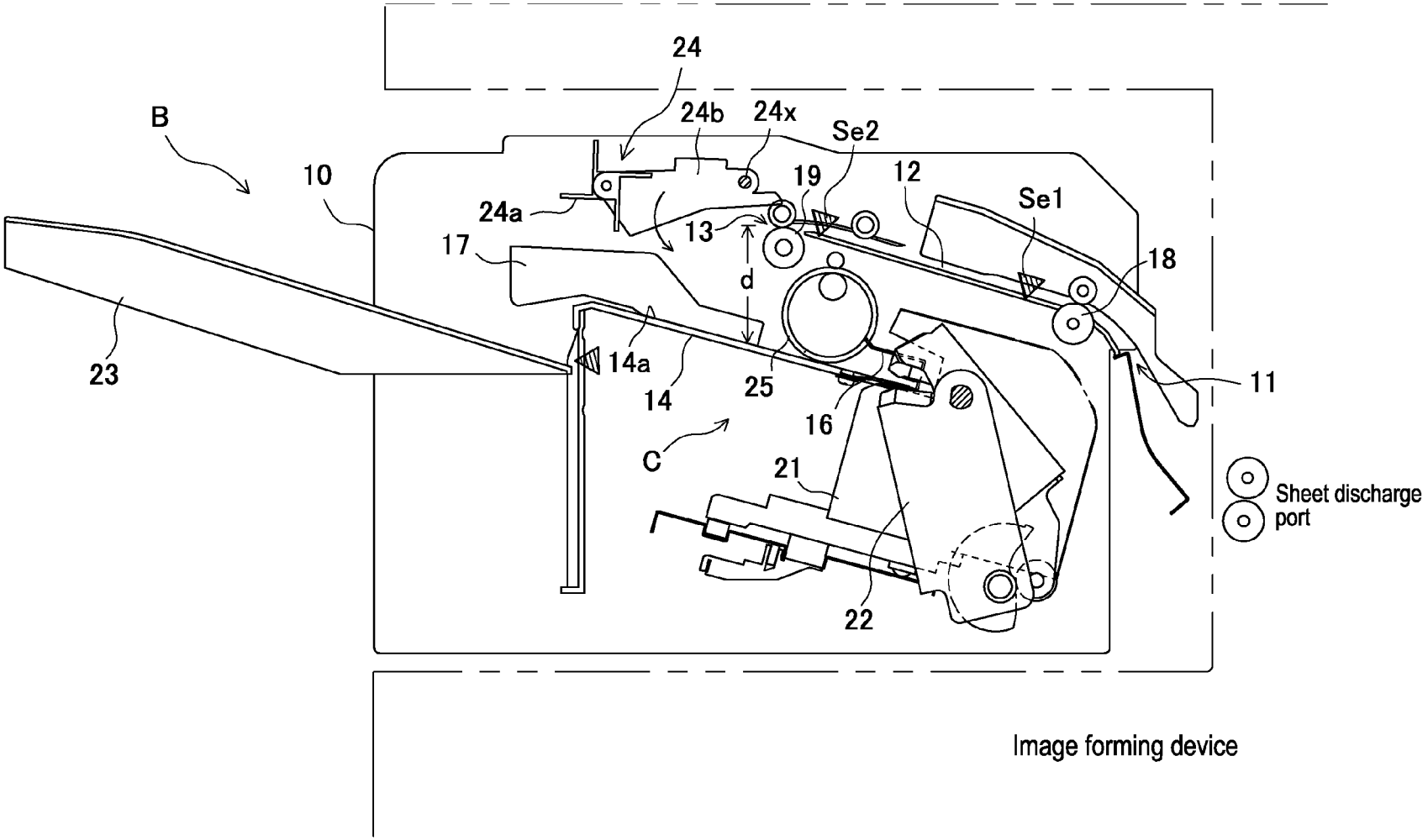
FIG. 1 is an explanatory view of a post-processing device according to the present invention.

The present invention will be described below based on an illustrated embodiment. FIG. 1 illustrates a post-processing device B that is disposed downstream of an image forming device and is configured to align and bind image-formed sheets. The post-processing device B incorporates therein a sheet accumulating device C according to the present invention.

[Post-Processing Device]

The post-processing device B illustrated in FIG. 1 will be described. The illustrated post-processing device B incorporates therein the sheet accumulating device C (processing tray mechanism) and is configured as a terminal device of an image forming system. In FIG. 1, the post-processing device B includes a device housing 10, a sheet conveying path 12 disposed inside the device housing 10, a processing tray 14 (sheet support section) disposed downstream of a sheet discharge port 13 of the sheet conveying path 12 and having a sheet loading surface 14*a*, and a stack tray 23 disposed downstream of the processing tray 14.

As illustrated in FIG. 1, the sheet conveying path 12 having a carry-in port 11 and the sheet discharge port 13 is disposed inside the device housing 10. In the illustrated example, the sheet conveying path 12 is configured to receive a sheet S fed in a horizontal direction, convey the sheet S in substantially the horizontal direction, and discharge the sheet S from the sheet discharge port 13. The sheet conveying path 12 incorporates therein a feeder mechanism (conveying rollers 18, 19, etc.) that conveys the sheet S.

The feeder mechanism is constituted by conveying roller pairs disposed at an interval according to a path length.

Specifically, a carry-in roller pair 18 is disposed near the carry-in port 11, and a discharge roller pair 19 is disposed near the sheet discharge port 13. The carry-in roller pair 18 and the discharge roller pair 19 are connected to the same drive motor (not illustrated) and convey the sheet S at the same peripheral speed.

The sheet conveying path 12 is provided with a sheet sensor Se1 and a discharge sensor Se2 each detecting at least one of leading and rear ends of the sheet S. The discharge sensor Se2 is disposed at the sheet discharge port 13 and detects the leading and rear ends of the sheet carried out from the sheet discharge port 13 to form a reference of a timing signal for subsequent sheet conveyance.

[Processing Tray]

The processing tray 14 is disposed downstream of the sheet discharge port 13 of the sheet conveying path 12 with a level difference d interposed therebetween. The processing tray 14 has the sheet loading surface 14*a* that supports at least a part of the sheet S in order to allow a plurality of sheets S fed from the sheet discharge port 13 to be stacked thereon in a bundle for accumulation. The processing tray 14 is configured to accumulate the sheet S fed from the sheet discharge port 13 in a bundle, to align the sheets S in a predetermined posture, to bind the sheets S, and to discharge the resultant sheet bundle to the downstream side stack tray 23.

[Paddle Conveying Mechanism]

A sheet carry-in section 24 (paddle conveying mechanism) is disposed downstream of the sheet discharge port 13 and is configured to convey the sheet fed from the sheet discharge port 13 onto the sheet loading surface 14*a* of the processing tray 14. The illustrated sheet carry-in section 24 is constituted by a paddle conveying mechanism. Specifically, the sheet is conveyed by a paddle member 24*a* having a plurality of elastic blades disposed in a peripheral direction of a rotary shaft 24*x* connected to a not illustrated drive motor. The illustrated paddle member 24*a* is mounted to a swing bracket 24*b* and lowered onto the processing tray 14 at a sheet conveying timing to convey the sheet in a direction opposite to a sheet discharge direction in FIG. 1.

The paddle conveying mechanism is controlled based on the sheet rear end detection signal from the above discharge sensor Se2. Further, there is provided, on the processing tray 14, a raking conveying mechanism (sheet carry-in mechanism) 25 that conveys the sheet fed by the paddle conveying mechanism 24 to a predetermined processing position. A configuration of the raking conveying mechanism 25 will be described later.

[Sheet Regulation and Alignment]

A configuration of the processing tray 14 will be described based on FIG. 1. A sheet end regulating member 16 that positions the sheet S is provided at a leading end portion (rear end portion in a sheet discharge direction, in the illustrated example) of the processing tray 14. The sheet end regulating member 16 makes the sheet S carried therein from the sheet discharge port 13 by the raking conveying mechanism (sheet carry-in mechanism) 25 abut thereagainst for regulation. The sheet end regulating member 16 aligns the sheets S accumulated on the processing tray to a predetermined position for processing.

Further, a side edge aligning member 17 that positions a width direction of the sheets S that have been positioned by the sheet end regulating member 16 to a reference position is provided in the processing tray 14. The illustrated side edge aligning member 17 aligns the width of the sheets S that have been positioned by the sheet end regulating member 16 in a direction perpendicular to the sheet discharge direction. The side edge aligning member 17 is constituted by a pair of left and right aligning plates and positions the sheets S to a predetermined reference line (center line or side line).

The illustrated processing tray 14 is provided with a post-processing section 21 (22) that applies post-processing to the accumulated sheets S. As a device that applies post-processing to the sheets S accumulated on the processing tray, various devices such as a binding section, a punch section, a stamp section, and a trimming section may be adopted. In the illustrated example, a staple binding section 21 and a pressure binding section 22 are provided and used selectively to perform the post-processing to the sheets S accumulated on the processing tray. A configuration of the binding device 21 (22) is well known, so description thereof will be omitted.

[Sheet Carry-In Mechanism of Processing Tray]

The present invention relates to the sheet carry-in mechanism 25 that guides, to the sheet end regulating member 16, the sheet fed onto the processing tray 14 from the sheet discharge port 13. The sheet carry-in mechanism 25 carries the sheet fed from the sheet discharge port 13 onto a topmost one of the sheets stacked on the sheet loading surface 14*a*. Thus, it is necessary for the sheet carry-in mechanism 25 to apply uniform pressing force to the sheets even if a sheet loading amount is changed and to make the sheet abut against the sheet end regulating member 16 while correcting curling of the sheet with an appropriate pressing force.

Figure 2:
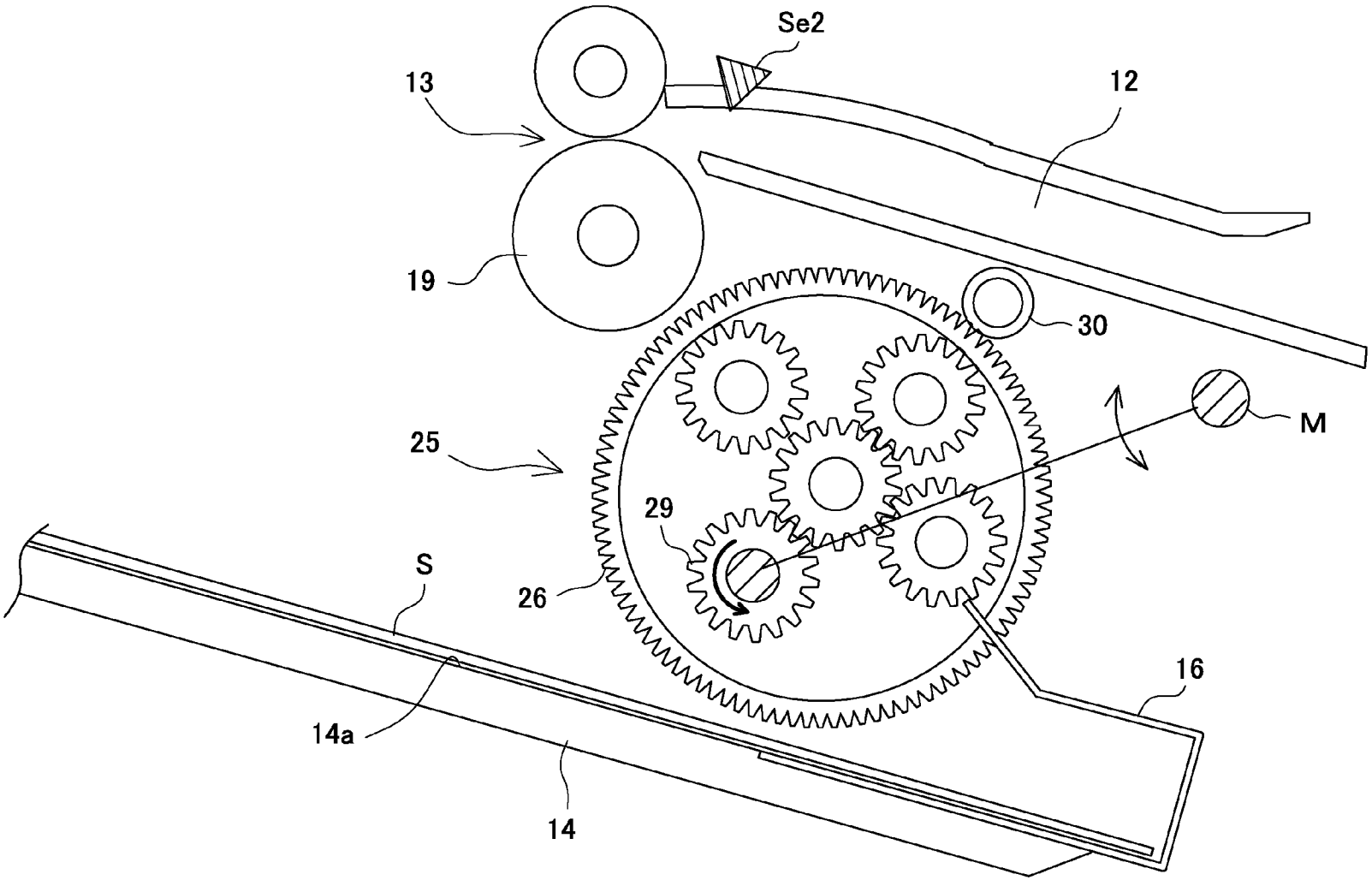
FIG. 2 is an explanatory view of a sheet carry-in mechanism in the device of FIG. 1.

To realize this, the sheet carry-in mechanism 25 is configured as follows. As illustrated in FIG. 2, the sheet carry-in mechanism 25 is constituted by a conveying belt 26 which is a ring-shaped endless belt, a driving rotating member 27 engaged with an inner peripheral surface 26*a* of the conveying belt, a driven rotating member 30 engaged with an outer peripheral surface 26*b* of the conveying belt, and a drive section M (drive motor) that gives a rotational force to the driving rotating member 27.

In the present embodiment, the driving rotating member 27 is driven by the drive section M to thereby rotate the conveying belt 26; however, the present invention is not limited to this, a drive force may be given to the driven rotating member 30 by the drive section M, or a drive force may be given directly to both the driving rotating member 27 and the driven rotating member 30.

[Conveying Belt]

The conveying belt 26 is constituted by a flexible endless-shaped (ring-shaped) belt member and is disposed above the sheet loading surface 14*a*. The conveying belt 26 is formed of a rubber material containing, e.g., reinforced fiber. The conveying belt 26 has a predetermined belt width 26*w* in a direction (sheet width direction) crossing the sheet conveying direction and an appropriate thickness 26*t*. Reverse V-shaped convex surfaces 26*b* (convex portion) to be described later are formed on a belt surface (outer peripheral surface (outer peripheral portion)), and ribs 26*r* for preventing displacement of the belt are formed on an inner peripheral surface of the belt. As the ribs 26*r*, a plurality of convex surfaces are formed in the peripheral direction of the belt so as to each extend in a direction crossing (at right angles, in the present embodiment) the conveying direction.

[Driving Rotating Member]

The driving rotating member 27 is a rotating body having a shape with a concave cross-section, such as a pulley shape or a roll shape with a flange that is constituted by left and right opposing flange portions 27*f* and a drum portion 27*d* positioned between the flange portions 27*f*. The driving rotating member 27 is formed of a metal material or a synthetic resin material. The drum portion 27*d* is formed to have a dimension fitted to the rib 26*r* (whose shape will be described later) formed on the inner peripheral surface of the conveying belt 26.

As illustrated in FIG. 2, a plurality of rotating members are provided as the driving rotating members 27 so as to give a rotational force to the conveying belt 26. Specifically, a first driving rotating member 27*a*, a second driving rotating member 27*b*, and a third driving rotating member 27*c* are disposed at predetermined intervals (at 45-degree intervals, in the illustrated embodiment) so as to be each engaged with the inner peripheral surface of the belt member 26.

The first, second, and third driving rotating members 27*a*, 27*b*, and 27*c* are axially supported at their rotary axis 27*x* by a not-illustrated wheel-shaped frame (hereinafter, referred to as "wheel"). Transmission gears 27*y* meshed as illustrated are integrally formed with the respective driving rotating members 27.

An intermediate gear 28 is rotatably axially supported at a position meshed with the first, second, and third transmission gears 27*y* and is connected with a drive gear 29 connected to the drive motor M.

The drive motor M (output shaft thereof is illustrated in FIG. 2) is mounted to a device frame to which the processing tray 14 is mounted, and a rotation thereof is transmitted to the drive gear 29. The rotation of the drive motor causes the conveying belt 26 illustrated in FIG. 2 to be rotated in a counterclockwise direction.

Figure 3A:
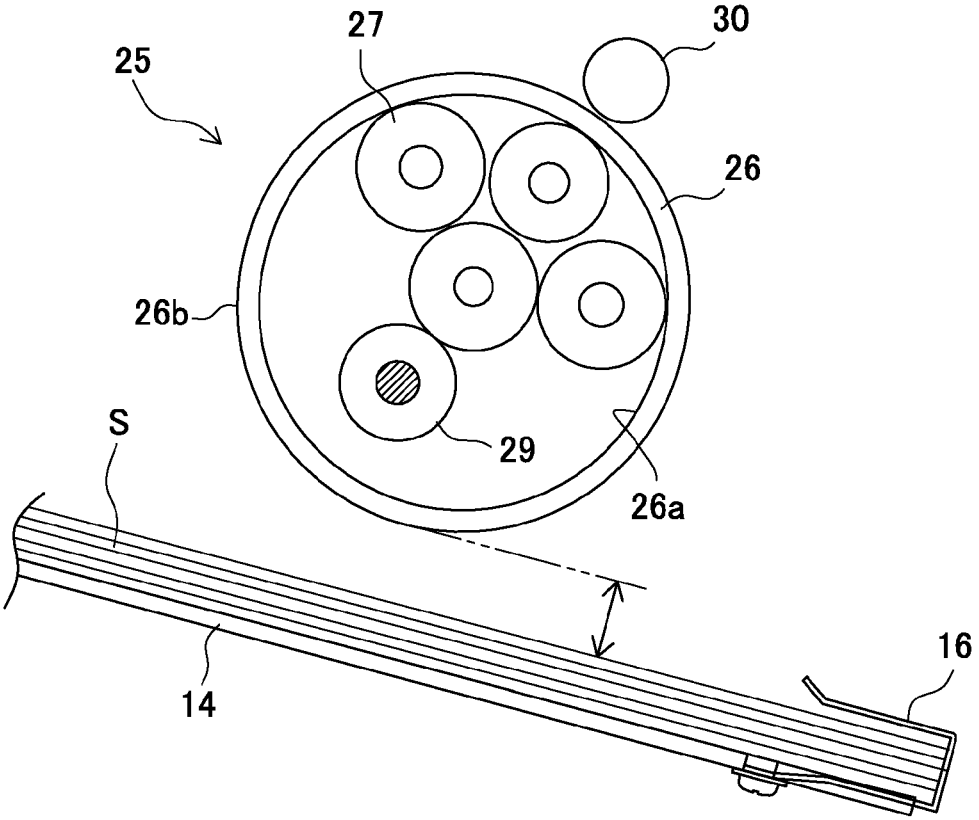
Figure 3B:
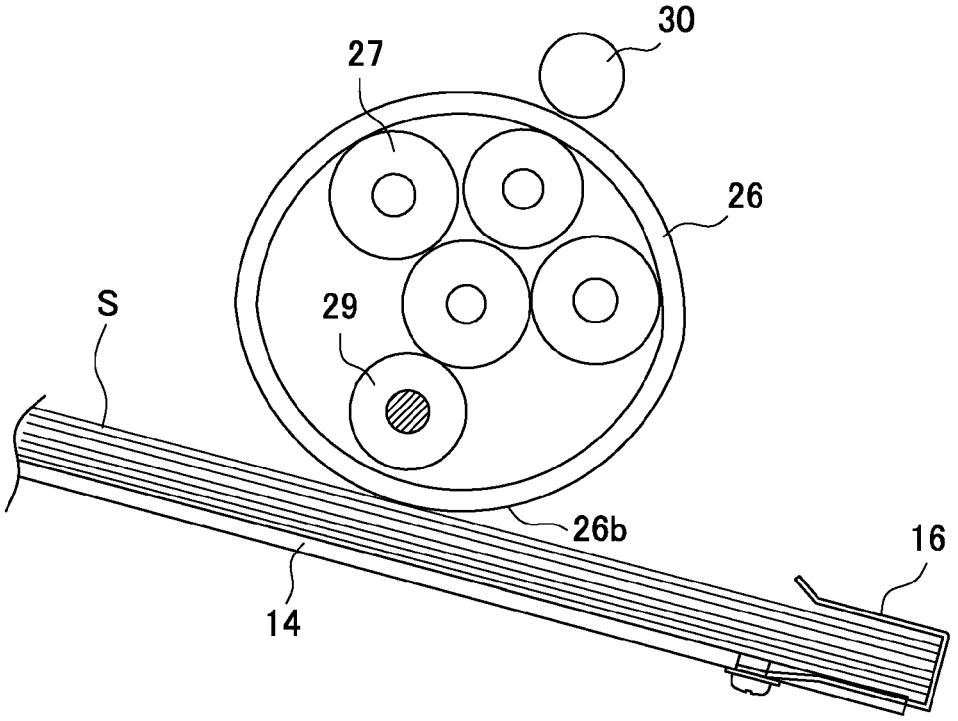

The wheel (not illustrated) mounting the rotating members 27 is provided with a lift mechanism that can move the conveying belt 26 to a standby position (FIG. 3A) retracted upward from the sheet loading surface 14*a* by a predetermined distance and an operating position (FIG. 3B). The lift mechanism may be realized by an arm member swingably supported by the device frame. More specifically, the wheel is connected to a leading end of the arm member, and a base end portion of the arm member is made to swing by means of a swing section such as a motor or a solenoid.

[Driven Rotating Member]

The driven rotating member 30 is engaged with the outer peripheral surface 26*b* of the conveying belt 26 to be driven into rotation in a travel direction of the conveying belt 26 and holds the belt between itself and driving rotating members 27 engaged with the inner peripheral surface 26*a*. In the device illustrated in FIG. 2, the driven rotating member 30 has a roll structure where it is engaged with the belt outer peripheral surface at a position opposite to the first driving rotating member 27*a* to be driven into rotation.

The driven rotating member 30 is formed of a hard synthetic resin roll member or a metal roll member. That is, the belt member 26 is formed of a soft material such as rubber, and the driven rotating member 30 is formed of a material having higher hardness than that of the belt member.

The illustrated driven rotating member 30 has a width substantially equal to the belt width 26*w* and does not have a flange portion to fit the belt.

Figure 4A:
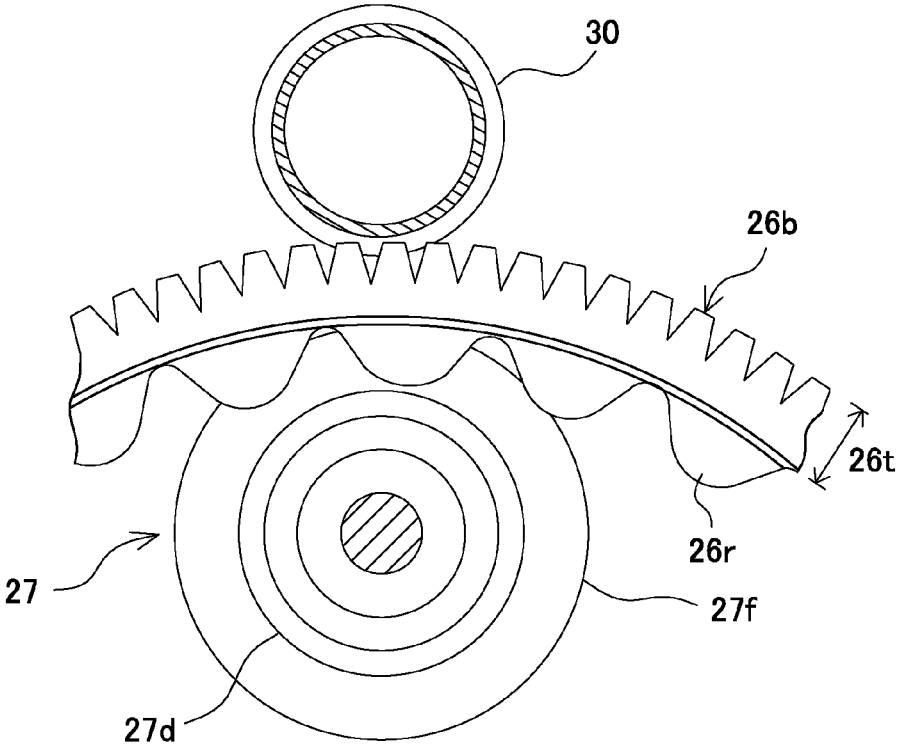

As illustrated in FIG. 4A, the convex surfaces each extending in the belt width direction (in a direction perpendicular to the travel direction) are formed in the peripheral direction on the outer peripheral surface 26*b* of the conveying belt 26 at predetermined pitches. This can prevent excessive contact and friction between the belt and sheet upon sheet conveyance to ensure reliable sheet conveyance. The convex surface may be formed to have various cross-sectional shapes including a reverse V-shape, a reverse U-shape, a quadrangular shape, and a trapezoidal shape, and the like.

The driven rotating member 30 has an outer diameter portion that contacts the convex surfaces formed on the outer peripheral surface 26*b* of the conveying belt 26 and an outer diameter portion that does not contact the convex surfaces even within a range where it is engaged with the outer peripheral surface 26*b* of the conveying belt 26. That is, the driven rotating member 30 has portions different in contact pressure. The contact portion and the non-contact portion are formed in a single member in the present embodiment; however, they may be formed in separate members, respectively. Further, the non-contact portion need not be formed as a completely non-contact portion.

First Embodiment

Figure 4B:
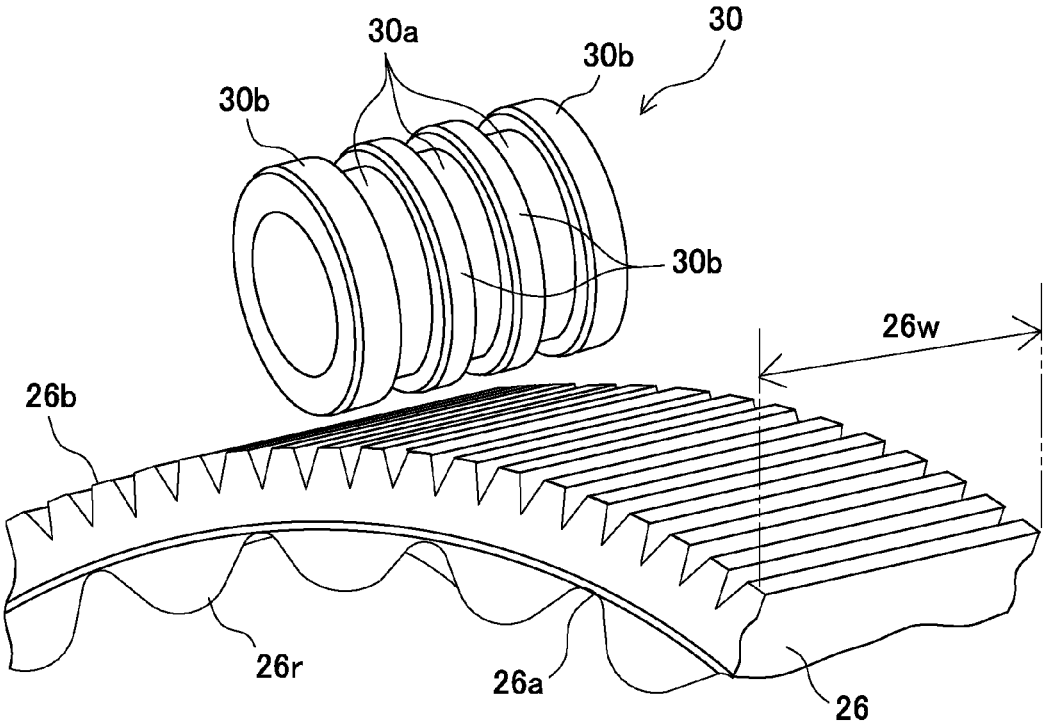

As illustrated in a perspective view of FIG. 4B, concave grooves 30*a* are formed on an engagement surface of the driven rotating member 30 (a cylindrical rotating member which has a contact portion 30*b*) to be engaged with the conveying belt 26 along the peripheral surface of the driven rotating member 30. That is, the concave grooves 30*a* (non-contact portions) are lower in height than the other peripheral surfaces (contact portions) and therefore does not contact the convex surfaces of the conveying belt 26.

A length of a contact area between the contact portions 30*b* and the convex surface 26*b* in the width direction of the conveying belt 26 is smaller than a length of the convex surface 26*b* in the width direction of the conveying belt 26. With this, in the width direction of the conveying belt 26, the convex surface 26*b* of the conveying belt 26 receives a pressure from the driven rotating member 30 at a first portion (a part of the convex surface 26*b* that is brought into contact with the contact portion 30*b*, in the present embodiment) and receives a pressure lower than that the first portion receives at a second portion (a part of the convex surface 26*b* that is opposite to the concave groove 30*a*, in the present embodiment) (in the present embodiment, the second portion receives no pressure from the driven rotating member 30 (pressure is 0); however, a pressure higher than 0 and lower than the pressure that the first portion receives may be applied to the second portion). In the present invention, the pressure lower than that the first portion receives may include zero-pressure.

The driving rotating member 27 and the driven rotating member 30 are disposed opposite to each other with the conveying belt 26 interposed therebetween and nip the conveying belt 26 at a predetermined pressure. Thus, when the driving rotating member 27 receives a drive force from the drive section M, the driving rotating member 27 cooperates with the driven rotating member 30 to rotate the conveying belt 26.

Figure 5:
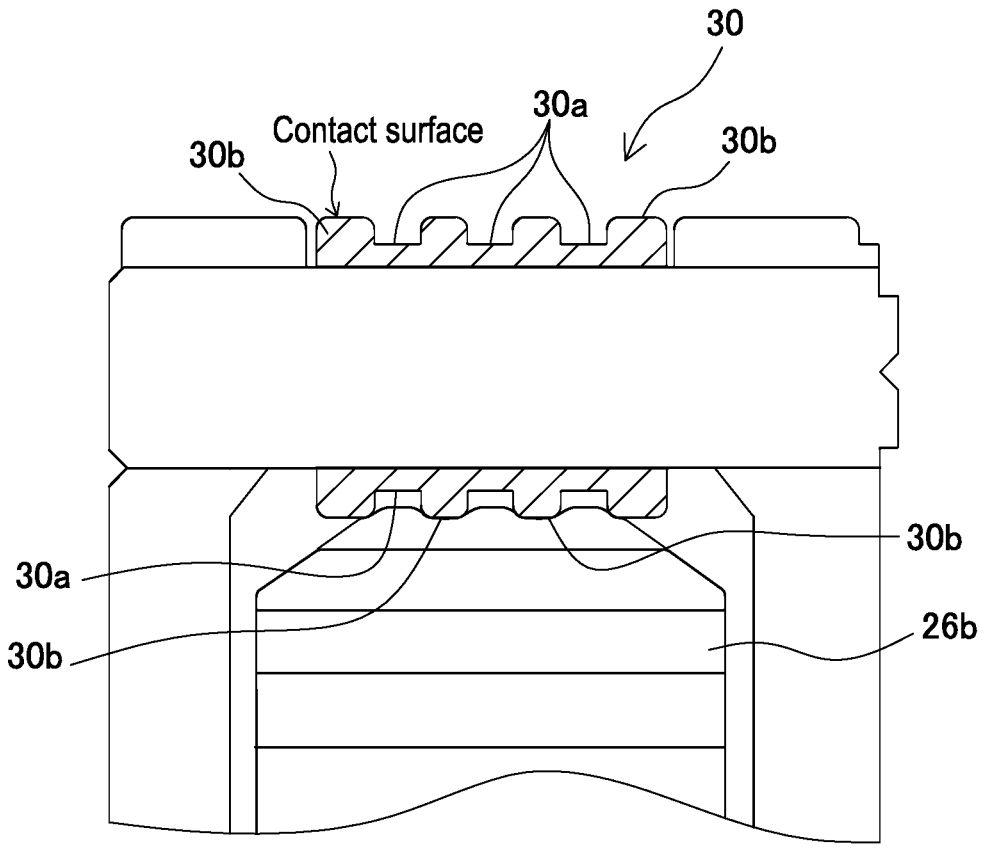
FIG. 5 is an explanatory view of an engagement state between a belt and a driven rotating member, which is a cross-sectional view when a slit groove is formed in the driven rotating member.
Figure 6:
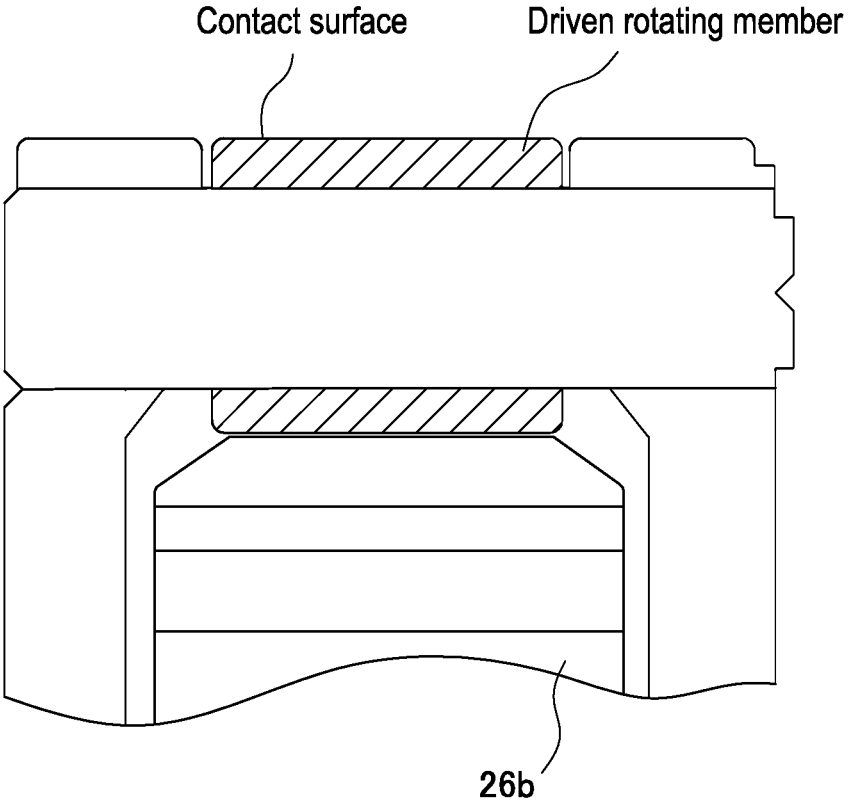
FIG. 6 illustrates a conventional structure (no slit is formed)

FIG. 5 illustrates a state where the above conveying belt 26 is nipped at a predetermined pressure between the driving rotating member 27 and the driven rotating member 30. In this state, the outer peripheral surface 26*b* of the conveying belt 26 is deformed by the plurality of contact portions 30*b* formed on the driven rotating member 30.

As described above, the convex surface of the conveying belt 26 is deformed following a shape of the concave groove 30*a* of the driven rotating member 30 to be in a flexed state. This can suppress flapping of the driven rotating member 30 when it overrides the convex surface of the conveying belt 26, thereby allowing noise reduction.

That is, the first portion (a part of the convex surface 26*b* that is brought into contact with the contact portion 30*b*, in the present embodiment) of the convex surface 26*b* of the conveying belt 26 in the width direction of the conveying belt 26 receives a pressure from the driven rotating member 30 to be deformed in a thickness direction of the conveying belt 26, and the second portion (a part of the convex surface 26*b* that is opposite to the concave groove 30*a*, in the present embodiment) is deformed in the thickness direction less than the first portion (in the present embodiment, the second portion receives no pressure from the driven rotating member 30, so that the deformation amount is 0; however, the deformation amount of the second portion may be made more than 0 and lower than the deformation amount of the first portion). In the present invention, the deformation amount less than that of the first portion may include zero deformation amount. Further, the concave groove 30*a* may be formed singularly or in plural as long as it can deform the convex surface.

Second Embodiment

Figure 7A:
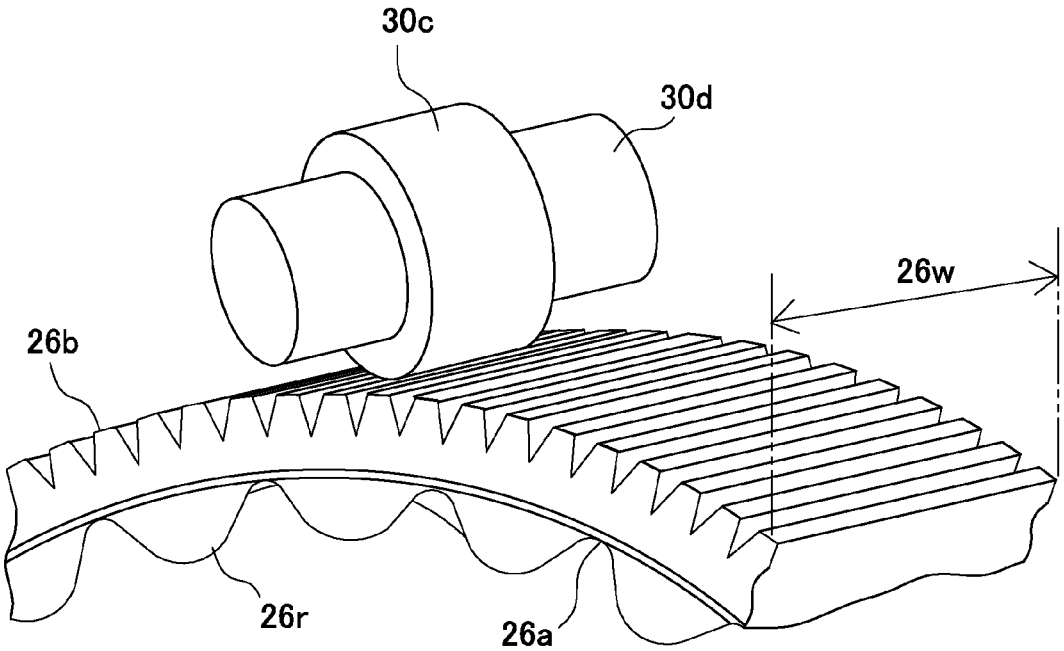

A second embodiment will be described based on FIGS. 7A and 7B. As illustrated in a perspective view of FIG. 7A, as an engagement surface of the driven rotating member 30 to be engaged with the conveying belt 26, a convex portion 30*c* is formed along the driven rotating member 30. That is, a part of the driven rotating member 30 that contacts the conveying belt 26 is limited to the convex portion 30*c*, and a peripheral surface of the driven rotating member 30 other than the convex portion 30*c* (i.e., non-contact portion 30*d*) does not contact the conveying belt 26.

A length of a contact area between the contact portion 30*c* and convex surface 26*b* in the width direction of the conveying belt 26 is smaller than a length of the convex surface 26*b* in the width direction of the conveying belt 26. With this, in the width direction of the conveying belt 26, the convex surface 26*b* of the conveying belt 26 receives a pressure from the driven rotating member 30 at a first portion (a part of the convex surface 26*b* that is brought into contact with the contact portion 30*c*, in the present embodiment) and receives a pressure lower than that the first portion receives at a second portion (a part of the convex surface 26*b* that is opposite to the non-contact portion 30*d*, in the present embodiment) (in the present embodiment, the second portion receives no pressure from the driven rotating member 30 (pressure is 0); however, a pressure higher than 0 and lower than the pressure that the first portion receives may be applied to the second portion). In the present invention, the pressure lower than that the first portion receives may include zero-pressure.

The driving rotating member 27 and the driven rotating member 30 are disposed opposite to each other with the conveying belt 26 interposed therebetween. When the driving rotating member 27 is rotated with the conveying belt 26 nipped at a predetermined pressure, a driving force is transmitted to the conveying belt 26.

Figure 7B:
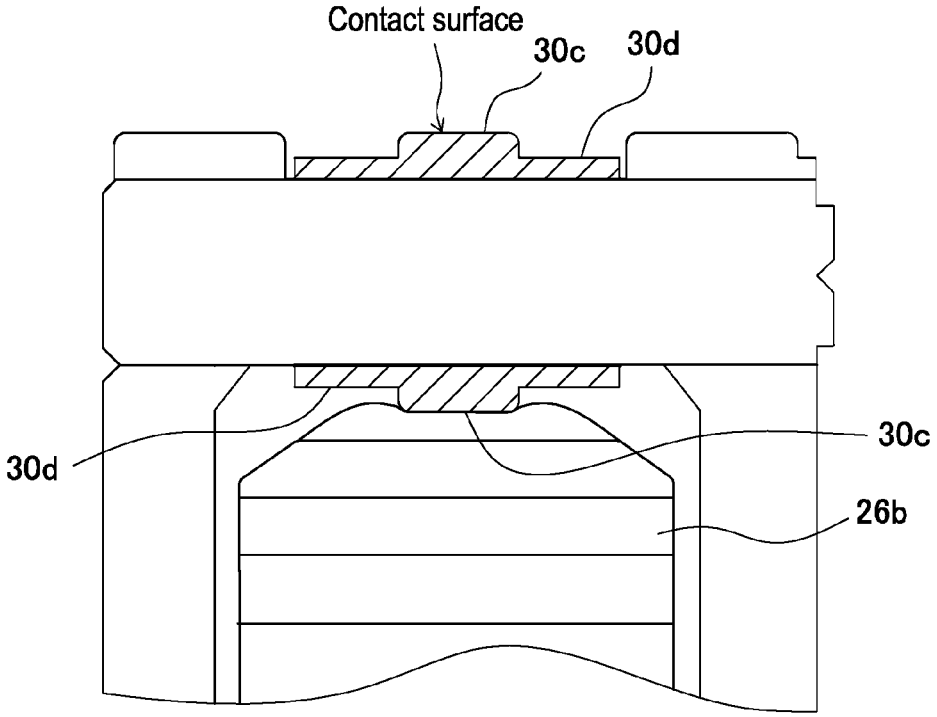

FIG. 7B illustrates a state where the above conveying belt 26 is nipped at a predetermined pressure between the driving rotating member 27 and the driven rotating member 30. In this state, the outer peripheral surface 26*b* of the conveying belt 26 is deformed following a shape of the convex portion 30*c* formed on the driven rotating member 30.

As described above, the convex surface of the conveying belt 26 is deformed following a shape of the convex portion 30*c* of the driven rotating member 30 to be in a flexed state. This can suppress flapping of the driven rotating member 30 when it overrides the convex surface of the conveying belt 26, thereby allowing noise reduction. That is, the first portion (a part of the convex surface 26*b* that is brought into contact with the contact portion 30*c*, in the present embodiment) of the convex surface 26*b* of the conveying belt 26 in the width direction of the conveying belt 26 receives a pressure from the driven rotating member 30 to be deformed in a thickness direction of the conveying belt 26, and the second portion (a part of the convex surface 26*b* that is opposite to the non-contact portion 30*d*, in the present embodiment) is deformed in the thickness direction less than the first portion (in the present embodiment, the second portion receives no pressure from the driven rotating member 30, so that the deformation amount is 0; however, the deformation amount of the second portion may be made more than 0 and lower than the deformation amount of the first portion).

In the present invention, the deformation amount less than that of the first portion may include zero deformation amount. Further, the convex portion 30*c* may be formed singularly or in plural as long as it can deform the convex surface.

What is claimed is:

1. A sheet conveying device, comprising:

an endless belt that gives a conveying force to a sheet; and a rotating member that contacts an outer peripheral portion of the endless belt and rotates with the endless belt, wherein the endless belt has, on its outer peripheral portion, first convex portions arranged in a peripheral direction of the endless belt, and each of the first convex portions extends in a width direction of the endless belt, the width direction is a direction intersecting a rotational direction of the rotating member, and the rotating member has a second convex portions, each of the second convex portions extends in a peripheral direction of the rotating member, the second convex portions are arrayed in the width direction, and each of the second convex portions contacts the outer peripheral portion of the endless belt.

2. The sheet conveying device according to claim 1, further comprising:

an inner peripheral portion rotating member that contacts an inner peripheral portion of the endless belt; and a drive section that gives a drive force to at least one of the rotating member and the inner peripheral portion rotating member.

3. The sheet conveying device according to claim 2, wherein the rotating member and the inner peripheral portion rotating member are disposed opposite to each other with the endless belt interposed therebetween.

4. The sheet conveying device according to claim 1, wherein the second convex portions constitute an outer periphery of the rotating member.

5. The sheet conveying device according to claim 1, wherein the outer peripheral portion of the endless belt is formed of a material softer than that of the second convex portions.

6. A sheet accumulating device comprising:

a sheet loading section on which a sheet conveyed from a conveying section is loaded;

a sheet conveying device that conveys the sheet that has been conveyed to the sheet loading section; and a sheet end regulating member that regulates an end portion of the sheet that has been conveyed by a sheet conveying device, wherein the sheet conveying device is the sheet conveying device as claimed in claim 1.

7. The sheet accumulating device according to claim 6, wherein the endless belt is disposed above the sheet loading section and is formed of a material that can be distorted in accordance with a loading amount of the sheets.

8. The sheet accumulating device according to claim 6, wherein the endless belt conveys the sheet in a direction opposite to a direction in which the conveying section conveys the sheet.

9. The sheet accumulating device according to claim 6, further comprising a sheet processing section that applies predetermined processing to the sheet.

10. The sheet accumulating device according to claim 9, wherein the sheet processing device is one of sections selected from among a binding section that binds a sheet bundle, a punch section that punches file holes in the sheet, a stamp section that stamps the sheet, a folding section that performs sheet folding processing, and a trimming section that trims the sheet.

* * * * *